US010246899B2

(12) United States Patent
Sartin

(10) Patent No.: US 10,246,899 B2
(45) Date of Patent: Apr. 2, 2019

(54) PORTABLE SHADE ASSEMBLY

(71) Applicant: Michael M. Sartin, Zachary, LA (US)

(72) Inventor: Michael M. Sartin, Zachary, LA (US)

( * ) Notice: Subject to any disclaimer, the term of this patent is extended or adjusted under 35 U.S.C. 154(b) by 171 days.

(21) Appl. No.: 15/627,954

(22) Filed: Jun. 20, 2017

(65) Prior Publication Data

US 2017/0362852 A1 Dec. 21, 2017

Related U.S. Application Data

(60) Provisional application No. 62/352,078, filed on Jun. 20, 2016.

(51) Int. Cl.

| | |
|---|---|
| ***E04H 15/58*** | (2006.01) |
| ***E04H 15/54*** | (2006.01) |
| ***E04H 15/32*** | (2006.01) |
| ***A45B 23/00*** | (2006.01) |
| *E04H 15/00* | (2006.01) |
| *A45B 11/00* | (2006.01) |

(52) U.S. Cl.

CPC ..... *E04H 15/58* (2013.01); *A45B 23/00* (2013.01); *E04H 15/32* (2013.01); *E04H 15/54* (2013.01); *A45B 11/00* (2013.01); *A45B 2023/0006* (2013.01); *A45B 2023/0093* (2013.01); *E04H 15/00* (2013.01)

(58) Field of Classification Search

CPC ..... E04H 15/54; E04H 15/32; E04H 15/00; E04H 15/58; E04H 15/48; E04H 15/06; E04H 15/08; E04H 15/02; A45B 23/00; A45B 11/00; A45B 2023/0006; E04F 10/04; E04F 10/02; E04F 10/0611; E04F 10/0618; E04F 10/0651; E04F 10/0655

See application file for complete search history.

(56) References Cited

U.S. PATENT DOCUMENTS

| | | | | | |
|---|---|---|---|---|---|
| 3,327,724 | A * | 6/1967 | Nielsen | E04F 10/0648 | 135/118 |
| 3,952,758 | A * | 4/1976 | Addison | B60P 3/343 | 135/88.07 |
| 4,630,627 | A * | 12/1986 | Windows | E04B 1/3441 | 135/116 |
| 4,658,877 | A * | 4/1987 | Quinn | E04F 10/0603 | 135/88.12 |
| 5,185,972 | A * | 2/1993 | Markiewicz | E04H 15/58 | 135/121 |
| 5,579,797 | A * | 12/1996 | Rogers | A45B 11/00 | 135/88.01 |
| 5,692,534 | A * | 12/1997 | Brumfield | E04H 15/322 | 135/115 |
| 6,494,246 | B1 * | 12/2002 | Blevins | E04F 10/0614 | 135/88.12 |

(Continued)

*Primary Examiner* — Beth A Stephan

(74) *Attorney, Agent, or Firm* — Ted M. Anthony

(57) ABSTRACT

A portable shade assembly for use in providing shade and sun protection, and thus substantially cooler temperatures, to an outdoor environment. More particularly, a shade assembly for use in providing sun and Ultraviolet (UV) protection for a variety of different industrial uses and for use in being transported to a variety of different locations. More particularly still, a portable shade assembly comprising a spring-loaded frame, a shade screen, and a continuous cable, wherein said cable is run throughout said frame, thereby being able to extend and retract said shade screen, as needed.

18 Claims, 8 Drawing Sheets

(56) References Cited

U.S. PATENT DOCUMENTS

| | | | | |
|---|---|---|---|---|
| 7,431,389 | B2 * | 10/2008 | Reeb | A47O 7/66 135/95 |
| 7,520,289 | B1 * | 4/2009 | Barber | A45B 23/00 135/20.3 |
| 8,978,678 | B1 * | 3/2015 | Ryan | E04H 15/10 135/150 |
| 9,353,529 | B2 * | 5/2016 | Richmeier | E04F 10/02 |
| 2008/0053624 | A1 * | 3/2008 | Ito | E04F 10/06 160/75 |
| 2010/0252207 | A1 * | 10/2010 | Westgarth | E04F 10/02 160/45 |
| 2012/0103377 | A1 * | 5/2012 | Sheridan | E04H 15/10 135/91 |
| 2013/0032186 | A1 * | 2/2013 | Lin | E04H 15/44 135/96 |
| 2013/0126104 | A1 * | 5/2013 | Weber | E04F 10/0618 160/79 |
| 2014/0251552 | A1 * | 9/2014 | Ma | E04F 10/04 160/45 |
| 2016/0273225 | A1 * | 9/2016 | Giglio | E04F 10/10 |

* cited by examiner

PORTABLE SHADE ASSEMBLY

CROSS REFERENCES TO RELATED APPLICATION

Priority of U.S. Provisional Patent Application Ser. No. 62/352,078, filed Jun. 20, 2016, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

Field of the Invention

The present invention pertains to a device for use in providing shade, and thus substantially cooler temperatures, in an outdoor environment. More particularly, the present invention pertains to a shade assembly for use providing sun protection and Ultraviolet (UV) protection for a variety of different industrial uses, including, but not limited to, improving a work environment for outdoor workers. More particularly still, the present invention pertains to a portable shade assembly that can be transported to a variety of different locations to provide sun and UV protection, depending on a particular desired use.

Brief Description of the Prior Art

Many people are subjected to heat or sun exposure on a jobsite, especially in a variety of different outdoor work environments. For example, outdoor operations conducted in hot weather and direct sun light, such as, for example, farm work, construction, oil and gas well operations, asbestos removal, landscaping, emergency response operations, and hazardous waste site activities, can increase the risk of heat-related illness in exposed workers. Furthermore, operations involving high air temperatures, radiant heat sources, high humidity, direct physical contact with hot objects, or strenuous physical activities have a high potential for causing heat-related illness.

Outdoor work environments are generally not ideal working conditions for employees, especially during summer months when the sun's UV rays are the most dangerous and temperatures can reach substantially high levels. This type of heat and sun exposure typically results in substantially higher worker fatigue and substantially decreased worker production. Likewise, every year, thousands of workers become sick from occupational heat exposure, with some even resulting in death. However, these illnesses and deaths can be preventable.

As such, there is a need for a portable shade assembly for use in a variety of different outdoor environments, including, but not limited to outdoor work environments, in order to create a substantially cooler and more comfortable work environment, thus increasing worker production, contributing to substantially less worker fatigue, and ultimately, increasing worker safety performance.

SUMMARY OF THE INVENTION

The present invention comprises a portable shade assembly for use in providing sun protection and UV protection to a variety of different outdoor activities, including, but not limited to an industrial work environment and thus protecting an outdoor workforce, or any other outdoor participant or user. The portable shade assembly of the present invention has a number of advantages, including, but not limited to, providing an easy and efficient set-up and installation, providing UV protection for a user, providing cooler working temperatures for a user, and creating a more comfortable outdoor environment. Moreover, the portable shade assembly of the present invention comprises a collapsible and spring-loaded frame that is able to easily absorb wind gusts and light impact, and therefore, can readjust and return to an original, set position on its own.

In a preferred embodiment, the portable shade assembly of the present invention comprises a portable and retractable shade screen that provides a means of transporting shade to an outdoor, or work, area instead of trying to transport a work area into limited shade. The portable shade assembly comprises a frame member, having a base, a plurality of substantially vertical leg members, a plurality of substantially horizontal support members, and a plurality of arm members. Said base provides a foundation for said portable shade assembly to be secured to a ground surface, and said leg members comprise a means for raising and supporting said horizontal support members and said shade screen.

Said horizontal support members comprise a first support member, or a rear beam, and a second support member, or a front beam. Said rear beam and said front beam are disposed in a substantially parallel configuration to each other and are connected by way of said arm members. Said arm members comprise a first hinge connection, wherein said first hinge connection is a point of attachment between said arm members and said rear beam. Further, said arm members comprise a third hinge connection, wherein said third hinge connection is a point of attachment between said arm members and said front beam. Additionally, said arm members comprise a first end and a second end, wherein said first and second end are connected via a second hinge member. A bumper member is located towards said second hinge member of said frame arms, thus, as a result, as arms are being extended, bumper comes into contact with hinge, and is therefore able to prevent said arms from hyperextending in a substantially outward direction.

The portable shade assembly of the present invention further comprises a substantially horizontal shade screen and a substantially vertical shade screen. Said horizontal shade screen is attachably connected to and coiled around a fabric reel, wherein said fabric reel is attachably connected to said rear beam of said frame. Additionally, said horizontal shade screen is also attachably connected to front beam of frame member. Fabric reel is operationally controlled by a fabric reel winch, wherein said fabric reel winch can manually wind or unwind said fabric reel, and thus said screen, by way of a cable that is continuously run through said frame member. Said vertical shade screen is attachably connected to a separate cable that can run substantially parallel to a back end of rear beam, wherein said vertical shade screen can be manually pulled along said separate cable in order to fully open and/or close said vertical screen across said frame member.

Furthermore, in a preferred embodiment, the portable shade assembly of the present invention comprises a tension winch, or a first winch, and a plurality of internal coiled springs that are disposed within said rear beam. Said first winch creates a tensional force that is used to stretch said coiled springs, thereby creating a pull on said continuous cable. This pull, or force, is then transferred to said second hinge of said arm members, thereby substantially straightening said arms and thus extending said frame member. Said force is further controlled by said shade screen that is connected to said fabric reel, wherein said fabric reel is operationally controlled by said fabric reel winch, or a second winch, located on said vertical support member of frame member.

As a user manually controls fabric reel, said arm members of said frame member and said horizontal shade screen simultaneously extend or retract, as desired. Therefore, said arm members can extend and retract, as necessary, whereby arm members extend as a shade screen is being rolled out, and then arm members retract as a shade screen is being rolled in.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
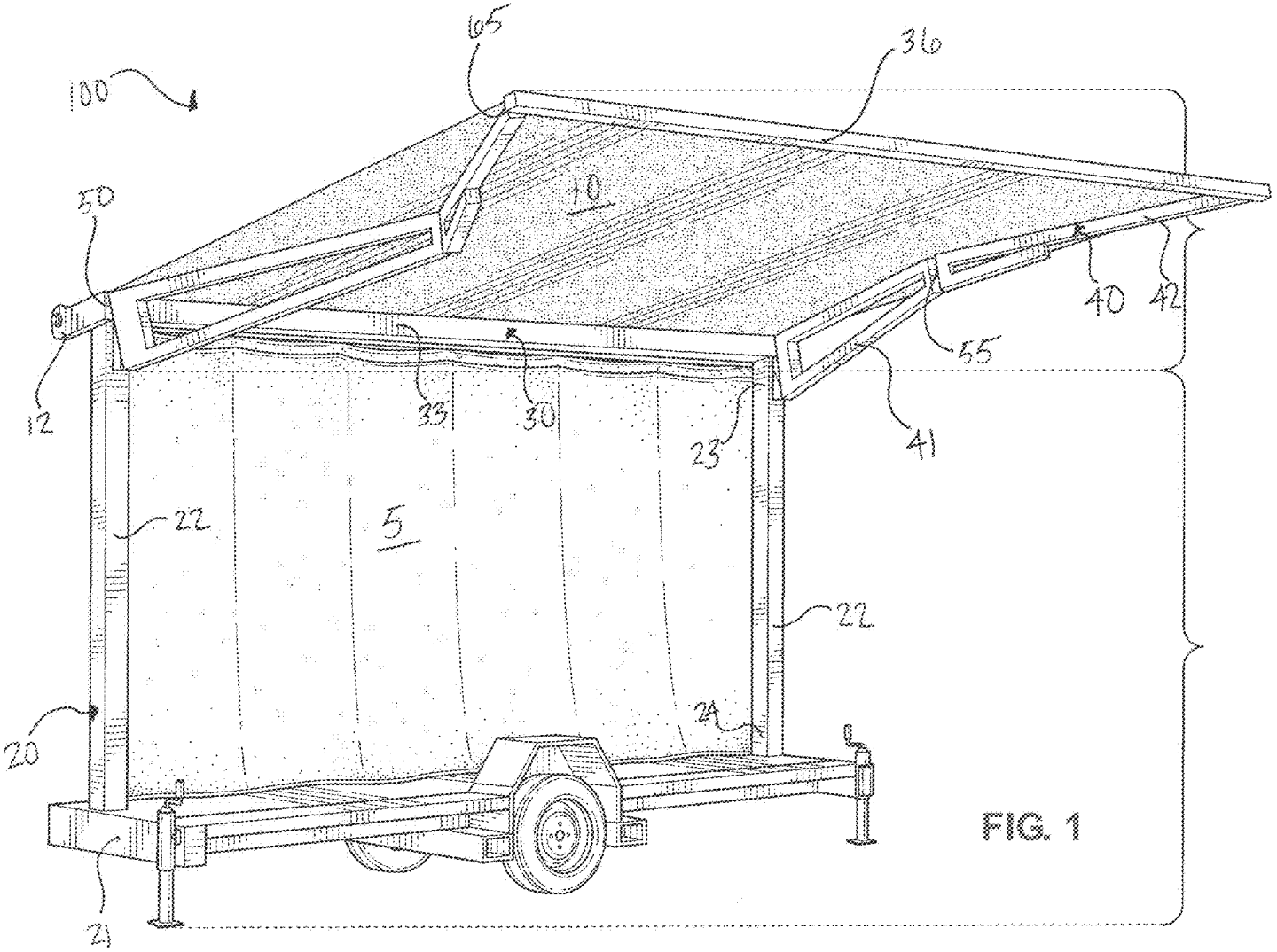
FIG. 1 depicts a perspective view of a preferred embodiment of a portable shade assembly of the present invention in an open configuration.

Referring to the drawings, FIG. 1 depicts a perspective view of a portable shade apparatus, or assembly, 100 of the present invention in an open configuration. In a preferred embodiment, portable shade assembly 100 of the present invention can have a variety of different designs and sizes, such as, for example, being used as an attachment to a trailer. However, by way of illustration, but not limitation, portable shade assembly 100 of the present invention can also be used to attach and mount to other devices, or can be used as a free-standing fabrication; thus shade assembly 100 does not have to be mounted or connected to any device, as desired. In addition, portable shade assembly 100 can be quickly and easily erected and can be easily transportable to a variety of different work areas, as needed.

Portable shade assembly 100 generally comprises a substantially rigid frame member 20, a substantially horizontal screen 10, and a substantially vertical screen 5. Frame member 20 typically comprises a base 21, a plurality of substantially vertical leg members 22, a plurality of substantially horizontal support members—a first support member 30 and a second support member 36, and a plurality of arm members 40. Said base 21 provides a means for portable shade assembly 100 to be secured to a ground surface, thereby providing a stable foundation when portable shade assembly 100 is extended or retracted. Additionally, in an alternate embodiment, base 21 provides a means for portable shade assembly 100 to be attachably connected to a variety of different devices, including, but not limited to, a trailer, or any other similar type of equipment.

Furthermore, in a preferred embodiment, vertical leg members 22 each comprise a top end 23 and a bottom end 24, wherein said bottom end 24 is attachably connected to said base 21 in a substantially perpendicular orientation, and said top end 23 is attachably connected to said first support member, or rear beam 30, in a substantially perpendicular orientation; thus, said base 21, said support legs 22, and said rear beam 30 coordinate to form a substantially rectangular shape having an inner opening 27. Additionally, said legs 22 can be adjustable or fixed to a desired height, as necessary.

In a preferred embodiment, arm members 40 comprise a first end 41 and a second end 42, whereby in the context of this discussion herein, it is to be observed that the second end 42 is said to be "forward" of the first end 41, and a direction from the first end 41 to the second end 42 will be referred to as "forward" in nature, when said arm members 40 are in an extending configuration. First end 41 of arm member 40 is attachably connected to rear beam 30, and second end 42 of arm member 40 is attachably connected to second support member, or front beam 36. Additionally, arm members 40 comprise a first hinge 50, a second hinge 55, and a third hinge 65, wherein said first hinge 50 is located at a connection point between said first end 41 of arm member 40 and rear beam 30, said second hinge 55 is located at a substantial mid-point within arm members 40, thus attachably connecting first end 41 of arm member 40 to second end 42 of arm member 40, and said third hinge 65 is located at a connection point between second end 42 of arm member 40 and front beam 36.

Still referring to FIG. 1, portable shade assembly 100 comprises substantially horizontal screen 10 and substantially vertical screen 5, wherein screen 10 and screen 5 can be manufactured from a variety of different textiles, materials, or fabrics that provide UV rated protection. Screen 10 is disposed on a screen, or fabric, reel 12, wherein one end of screen 10 is attachably connected to fabric reel 12 and an opposite end of screen 10 is connected to front beam 36. Fabric reel 12 is a separate component from frame member 20; however, a first end 13 and a second end 14 of fabric reel 12 are each attachably connected to rear beam 30 via a plate member 16 and a plurality of bolts 17, or any other similar attachment means (although not depicted in FIG. 1), and fabric reel 12 is attachably connected to front beam 36 via screen 10. As a result, in operation, when screen 10 is manually unwound from fabric reel 12, screen 10 moves in a substantially outward or "forward" direction from fabric reel 12, thus simultaneously moving front beam 36 in a substantially outward or "forward" direction and allowing frame member 20 to extend, while supporting screen 10.

Screen 5 is disposed along a substantially horizontal cable 92 that is attachably connected to plate members 16 via an eye bolt 94 connection, or any other similar attachment means; thus, cable 92 is oriented in a substantially parallel orientation to rear beam 30 and to fabric reel 12. One end of screen 5 can then be manually pulled along cable 92 from one support leg 22 to another support leg 22, thereby being in a fully open configuration in order to provide as much shade and sun protection as necessary.

In a preferred embodiment, when in operation, a user can position said portable shade assembly 100 into a desired location depending on said user's needs. Said user can then erect or extend portable shade assembly 100 by way of extending and unwinding screen 10, and thus, extending arm members 40. As arm members 40 are extending in a substantially "forward" or outward direction, screen 10 is simultaneously pushing front beam 36 in a substantially "forward" or outward direction from frame member 10. As a result, portable shade assembly 100 is in a fully open configuration, thereby providing sun protection as needed.

Figure 2:
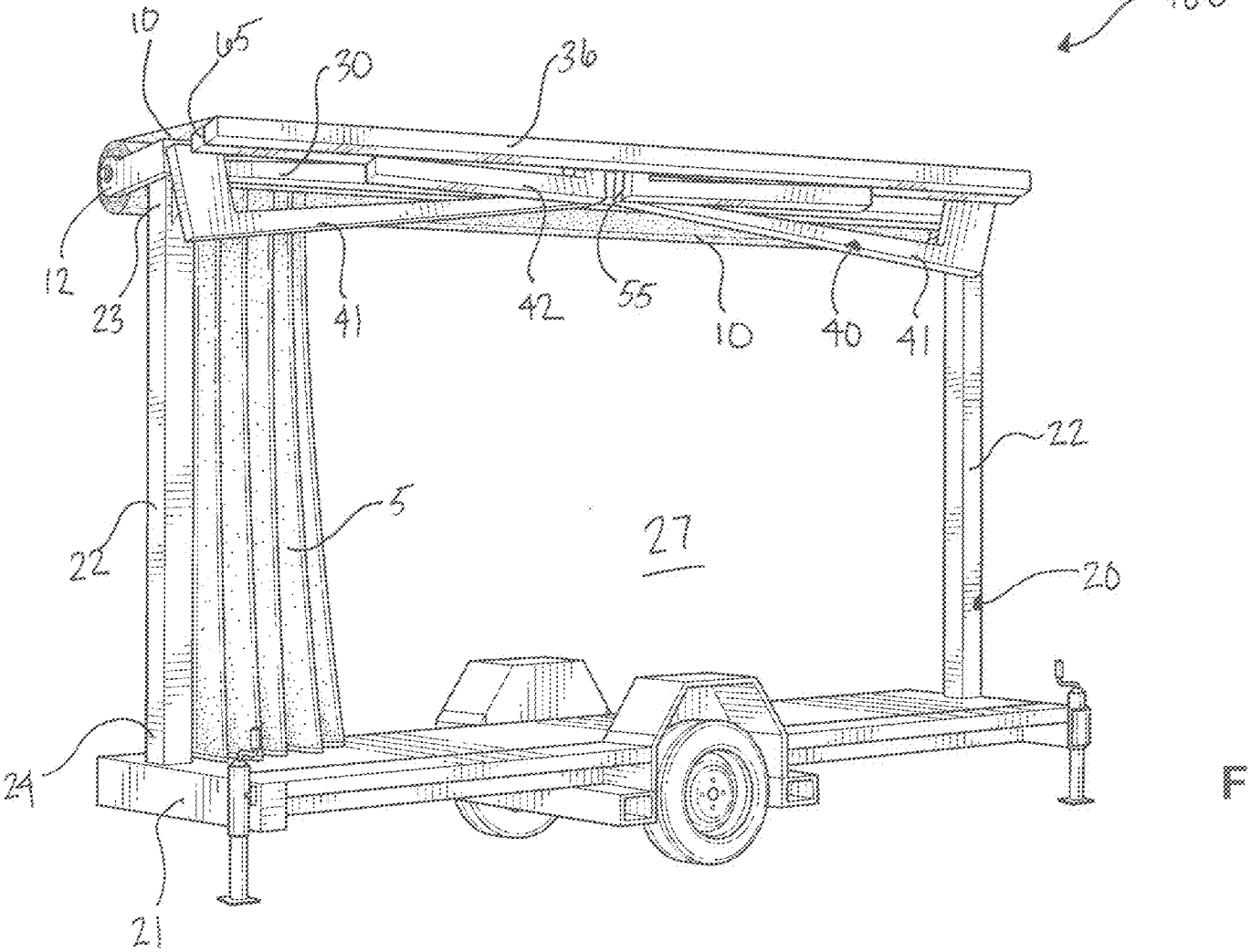
FIG. 2 depicts a perspective view of a preferred embodiment of a portable shade assembly of the present invention in a closed configuration.

FIG. 2 depicts a perspective view of portable shade assembly 100 in a closed configuration, wherein shade screen 10 and frame member 20 are in a retracted orientation. Portable shade assembly 100 comprises frame member 20, screen 10, and fabric reel 12. Frame 20 further comprises base 21, legs 22, rear beam 30, front beam 36, and frame arms 40, wherein bottom end 24 of legs 22 are attachably connected to base 21, and top end 23 of legs 22 are attachably connected to rear beam 30.

In a preferred embodiment, portable shade assembly 100 comprises first hinge 50, second hinge 55, and third hinge 65, wherein first hinge 50 attachably connects first end 41 of frame arm 40 to rear beam 30, second hinge 55 attachably connects first end 41 of frame arm 40 to second end 42 of frame arm 40, and third hinge 65 attachably connects second end 42 of frame arm 40 to front beam 36.

Additionally, screen 10 is located on fabric reel 12, wherein one end of screen 10 is attachably connected to fabric reel 12 and an opposite end of screen 10 is connected to front beam 36. Although fabric reel 12 is a separate component from frame member 20, fabric reel 12 is attachably connected to rear beam 30 via plate member 16 and bolts 17 (although not depicted in FIG. 2), and fabric reel 12 is attachably connected to front beam 36 via screen 10.

Still referring to FIG. 2, when portable shade assembly 100 is being retracted, and thus closed, arm members 40 are pulled in a substantially inward direction towards rear beam 30, wherein arm members 40 fold at second hinge 55, at first hinge 50, and at third hinge 65 in order to lay adjacent to rear beam 30. Simultaneously, screen 10 is being manually reeled, or wound, in a substantially inward or "backward" direction towards fabric reel 12, thereby pulling front beam 36 in a substantially inward or "backward" direction towards arm members 40 and rear beam 30, thus allowing frame member 20 to retract, while supporting screen 10. Additionally, screen 5 is then manually closed along cable 92, and thus, pulled back towards one support leg 22, thereby uncovering inner opening 27.

In a preferred embodiment, when in operation, when a user is no longer using portable shade assembly 100, said user can then retract portable shade assembly 100 by way of retracting or winding screen 10, and thus, retracting arm members 40. As arm members 40 are retracting in a substantially "backward" or inward direction, screen 10 is simultaneously pulling front beam 36 in a substantially "backward" or inward direction towards frame member. As a result, portable shade assembly 100 is in a fully retracted position, thereby allowing for an easier configuration for transport.

Figure 3:
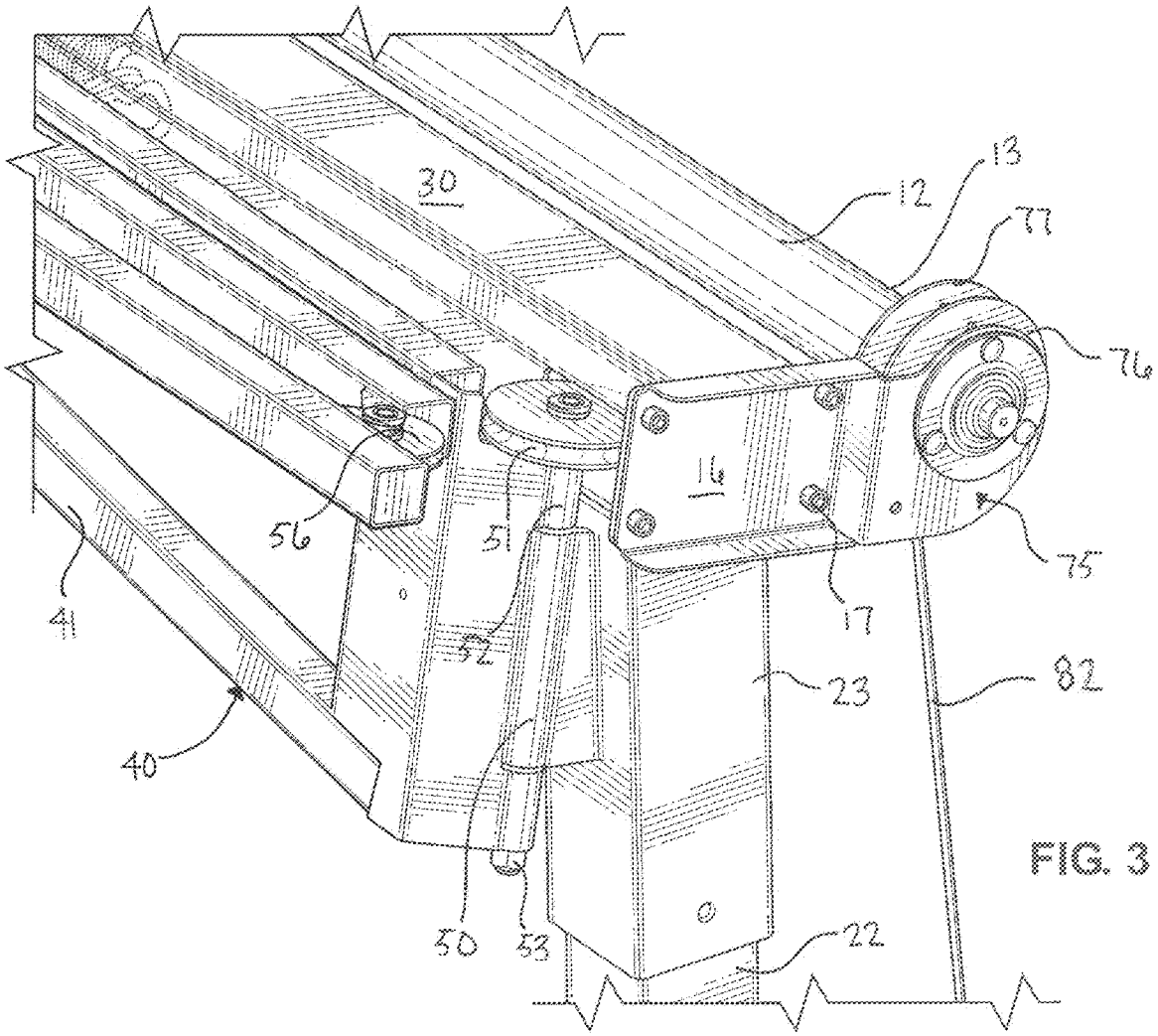
FIG. 3 depicts a side perspective view of a preferred embodiment of a first hinge connection of an arm member and a frame member of a portable shade assembly of the present invention in a retracted configuration.

FIG. 3 depicts a side view of first hinge 50 attachably connecting arm member 40 to frame member 20. First hinge 50 comprises a hinged attachment disposed between first end 41 of arm member 40 and rear beam 30, thereby allowing for extensible movement of arm member 40 relative to rear beam 30. First hinge 50 comprises a hinge pin 52 that is secured via a bolt 53, or any other similar attachment means, and further comprises a pulley 51 that allows a cable 62 to continuously run through frame member 20 (although not depicted in FIG. 3). Thus, pulley 51 provides a means of beneficially guiding cable 62 through frame member 20 as arm members 40 extend and retract, as desired.

Moreover, in a preferred embodiment, portable shade assembly 100 comprises fabric reel 12, wherein fabric reel comprises a first end 13 and a second end 14. First end 13 and second end 14 each comprise a plate member 16 and a plurality of bolts 17, or any other similar attachment means, that are used to attachably connect fabric reel 12 to rear beam 30. As a result, fabric reel 12 is a separate component part from frame member 20. First end 13 of fabric reel 12 further comprises a spool 75, having a central housing 78 disposed between an outer plate 76 and an inner plate 77. Spool 75 provides a means and a location for a reel cable 82 to be coiled within as fabric reel 12 is manually rolled up and screen 10 is retracted.

Figure 4:
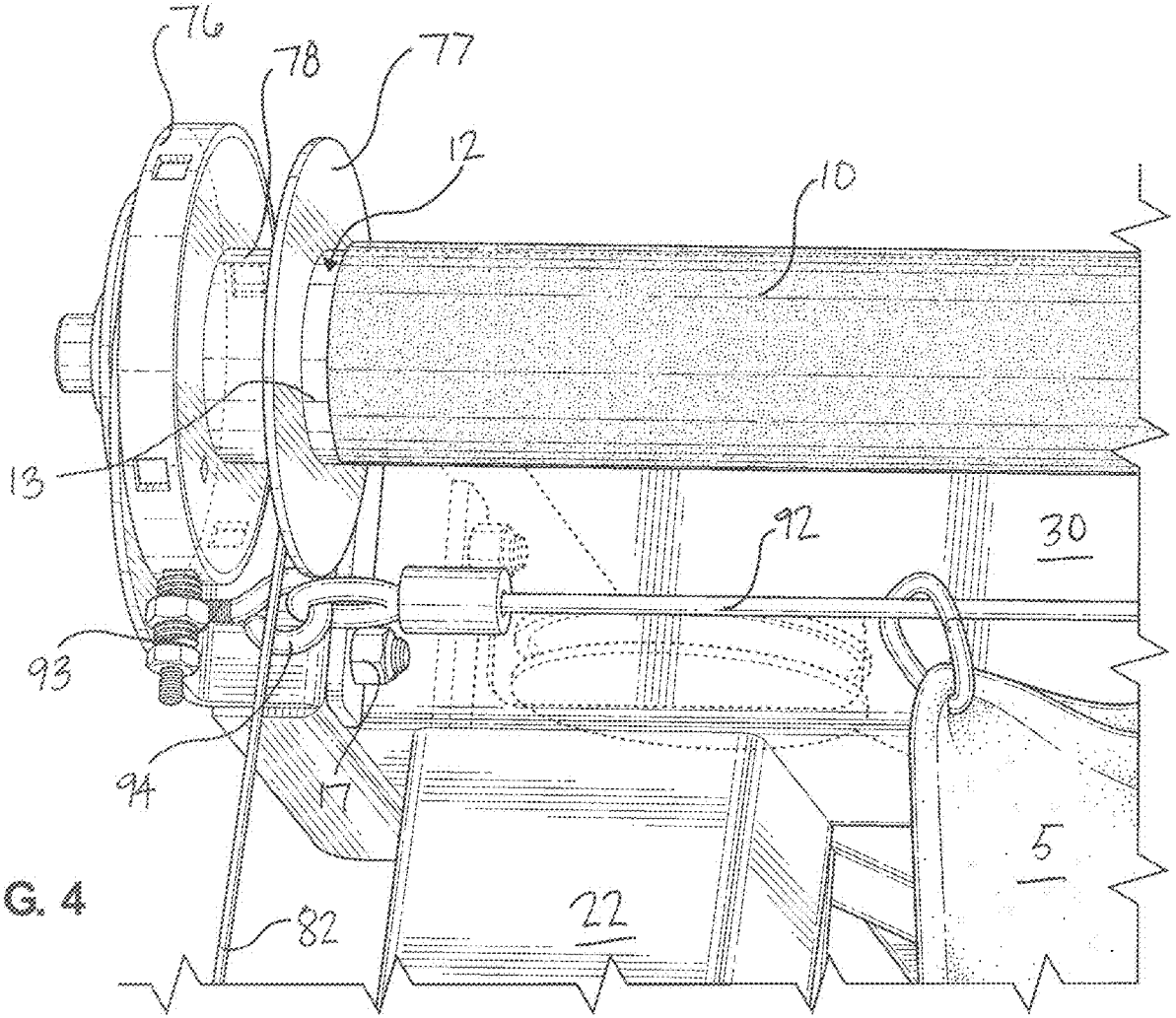
FIG. 4 depicts a rear end view of a preferred embodiment of a fabric reel of a portable shade assembly of the present invention.

FIG. 4 depicts a rear view of fabric reel 12 attachably connected to spool 75. Fabric reel 12 comprises a substantially cylindrical tube member having first end 13 and second end 14, although second end 14 is not depicted in FIG. 4. First end 13 is attachably connected to substantially circular spool 75 that provides a guide and a means for cable 82 to be wound or unwound, as necessary. Spool 75 comprises a reel lock bolt 93, wherein reel lock bolt 93 attachably locks spool into position. Spool 75 further comprises outer plate 76, inner plate 77, and central housing 78, wherein outer plate 76 and inner plate 77 are oriented substantially parallel to each other, and central housing 78 is disposed between outer plate 76 and inner plate 77. As such, central housing provides a location for cable 82 to be coiled or uncoiled as fabric reel 12 is being rolled or unrolled, respectively.

Additionally, screen 5 is disposed along substantially horizontal cable 92 that is attachably connected to plate members 16 via an eye bolt 94, or any other similar attachment means; thus, cable 92 is oriented in a substantially parallel orientation to rear beam 30 and to fabric reel 12. One end of screen 5 can then be manually pulled along cable 92 from one support leg 22 to another support leg 22, thereby being in a fully open configuration, as needed.

Figure 5:
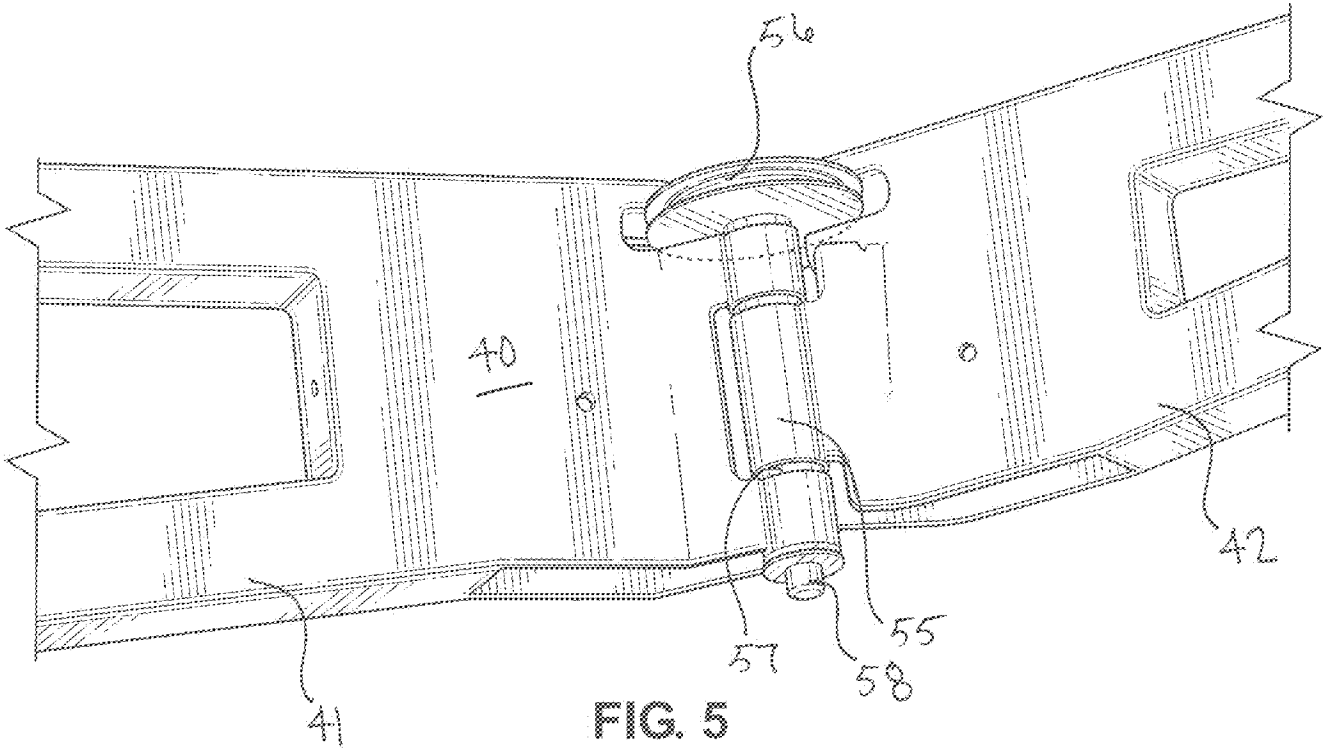
FIG. 5 depicts a side view of a preferred embodiment of a second hinge connection of an arm member of a portable shade assembly of the present invention in an open configuration.

FIG. 5 depicts a side view of second hinge 55 of arm member 40 in an extended configuration. Second hinge 55 is disposed between first arm member 41 and second arm member 42 and generally comprises a hinged connection that allows for arm member 40 to extend and retract, wherein hinged connection is secured by a hinge pin 57 and a bolt 58 mechanism, or any other similar attachment means. Further, second hinge 55 comprises a pulley 56 that allows cable 62 to run from rear beam 30, through arm members 40, through front beam 36, and back through arm members 40, thereby resulting in a continuous line of cable 62 throughout frame member 20. As a result, pulley 56 provides a means of beneficially guiding cable 62 as arm members 40 extend and retract, as desired.

Figure 6:
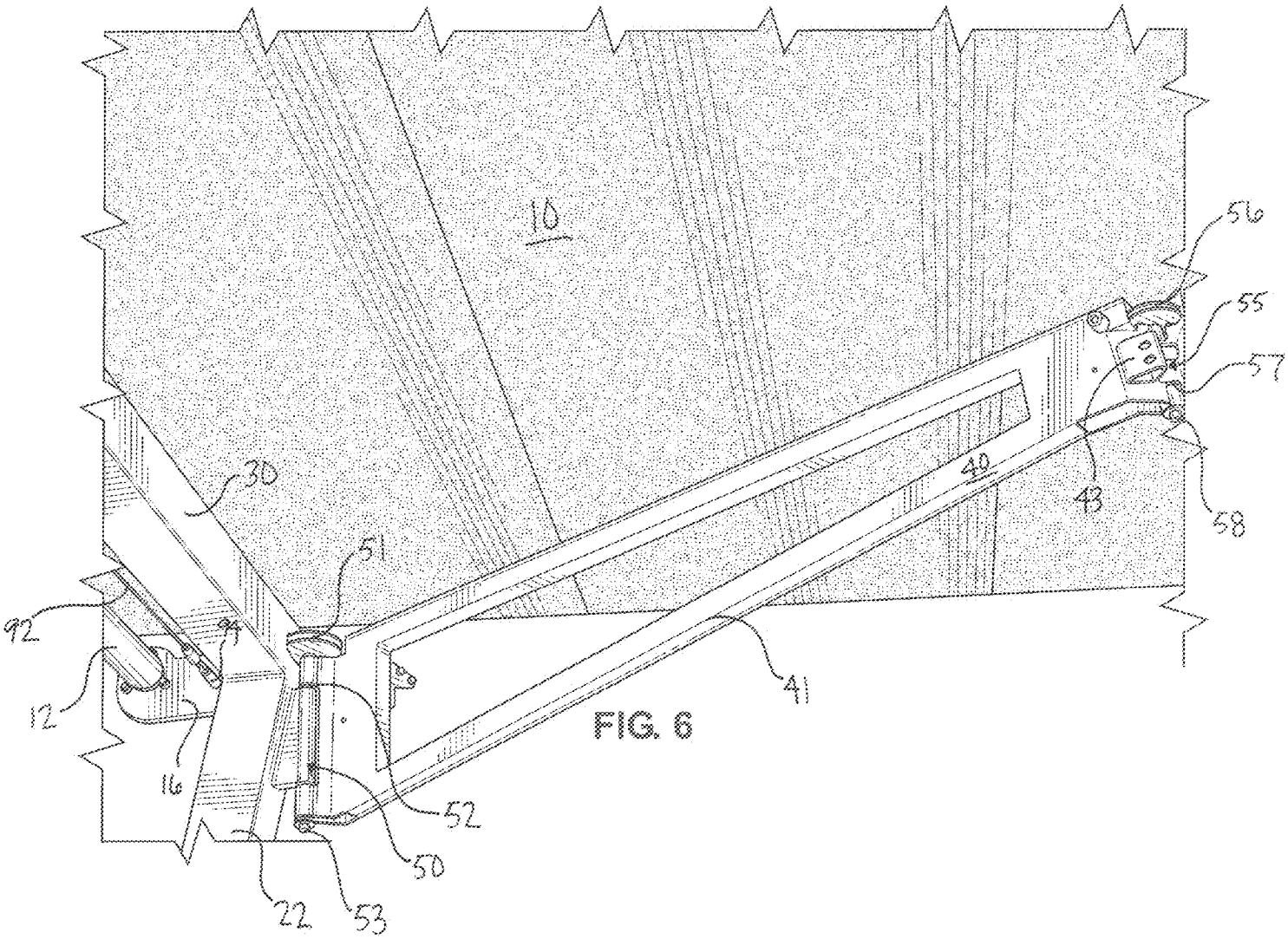
FIG. 6 depicts an alternate side view of a preferred embodiment of a first hinge connection and a second hinge connection of an arm member of a portable shade assembly of the present invention in an open configuration.

FIG. 6 depicts an alternate side view of arm member 40 in an extended configuration. Arm member 40 comprises first hinge connection 50, second hinge connection 55, and third hinge connection 65, wherein first hinge 50 connects first end 41 of arm member 40 to rear beam 30, second hinge 55 connects first end 41 to second end 42 of arm member 40, and third hinge 65 connects second end 42 of arm member 40 to front beam 36. First hinge 50 generally comprises a hinged connection that allows arm member 40 to have extensible movement away from or towards rear beam 30, wherein hinged connection is secured by a hinge pin 52 and a bolt 53 mechanism, or any other similar attachment means. Further, first hinge 50 comprises a pulley 51 that allows cable 62 to run from rear beam 30, through arm members 40, and ultimately, to front beam 36. As a result, pulley 51 provides a means of beneficially guiding cable 62 as arm members 40 extend and retract, as desired.

Although not depicted in FIG. 6, third hinge 65 generally comprises a hinged connection that allows arm member 40 to have extensible movement away from or towards front beam 36, wherein hinged connection is secured by a hinge pin and a bolt mechanism, or any other similar attachment means. Further, third hinge 65 comprises a pulley 66 that allows cable 62 to run from arm member 40, through front beam 36, and back through arm member 40. As a result, pulley 66 provides a means of beneficially guiding cable 62 as arm members 40 extend and retract, as desired.

Further, in a preferred embodiment, second hinge 55 attachably connects first end 41 to second end 42, wherein second hinge 55 comprises pulley 56 to assist in guiding cable 62 as arm members 40 are extended or retracted, as desired. Additionally, first end 41 of arm member 40 comprises a bumper member 43, wherein bumper 43 is disposed near second hinge 55. As a result, as frame arms 40 are being extended, bumper 43 comes into contact with second hinge 55, and thus, bumper 43 is able to prevent frame arms 40 from hyper-extending and swinging in a substantially outward direction.

Figure 7:
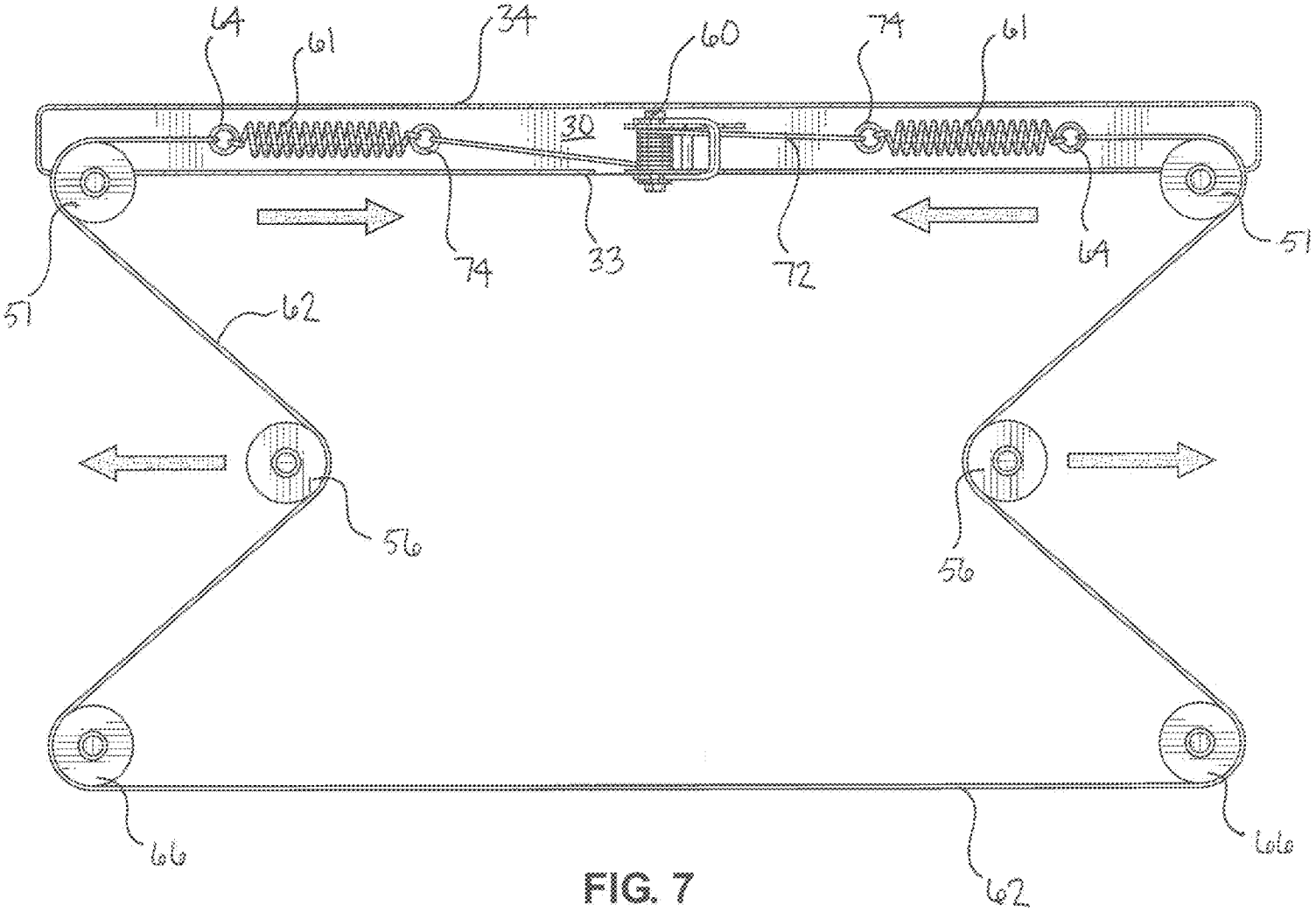
FIG. 7 depicts an aerial view of a preferred embodiment of a rear beam member of a portable shade assembly of the present invention, generally comprising a first winch member, a plurality of internal springs, and a cable.

FIG. 7 depicts an aerial view of substantially horizontal rear beam, generally comprising a first winch member 60 and a plurality of internal coiled springs 61. Rear beam 30 comprises a top end 31, a bottom end 32, a front end 33, and a back end 34, wherein said front end 33 is attachably connected to arm members 40 via first hinge 50, bottom end 32 is attachably connected to top end 23 of support legs 22, and back end 34 is attachably connected to fabric reel 12 via plate member 16 and bolts 17 (although not illustrated in FIG. 7). First winch 60 is disposed within rear beam 30 and is connected to coiled springs 61 by way of a winch cable 72; coiled springs 61 connect to cable 72 via a hook 74, or any other similar attachment means. Further, coiled springs 61 connect to cable 62 via a hook 64, or any other similar attachment means, wherein cable 62 runs continuously through frame member 20.

As a result, cable 72 runs from a substantially internal end of a first coiled spring 61, through first winch 60, to a substantially internal end of a second coiled spring 61, within rear beam 30. Furthermore, cable 62 runs from a substantially outer end of a first coiled spring 61 within rear beam 30, through a first arm member 40, through front beam 36, through a second arm member 40, and to a substantially outer end of a second coiled spring 61 within rear beam 30. Therefore, cable 72 and cable 62 are attachably connected via springs 61 to form a continuous cable unit.

In a preferred embodiment, first winch 60 is used to create a tensional force, thus operationally biasing internal coiled springs 61 and ultimately creating a tensional force on continuous cable 62. Said force is then transferred to second hinge 55 of arm members 40, which thus substantially straightens arm members 40 and extends front beam 36 of frame member 20. Further, said force is controlled by shade screen 10 attachably connected to fabric reel 12, wherein fabric reel 12 is further controlled by a second winch 70 located and clamped onto support leg 22. As such, the force to release or extend screen 10 is generated from internal springs 61 disposed within rear beam 30, wherein spring tension is adjustable. Frame 20 extension is thereby controlled by an amount of screen 10 that is released.

Figure 8:
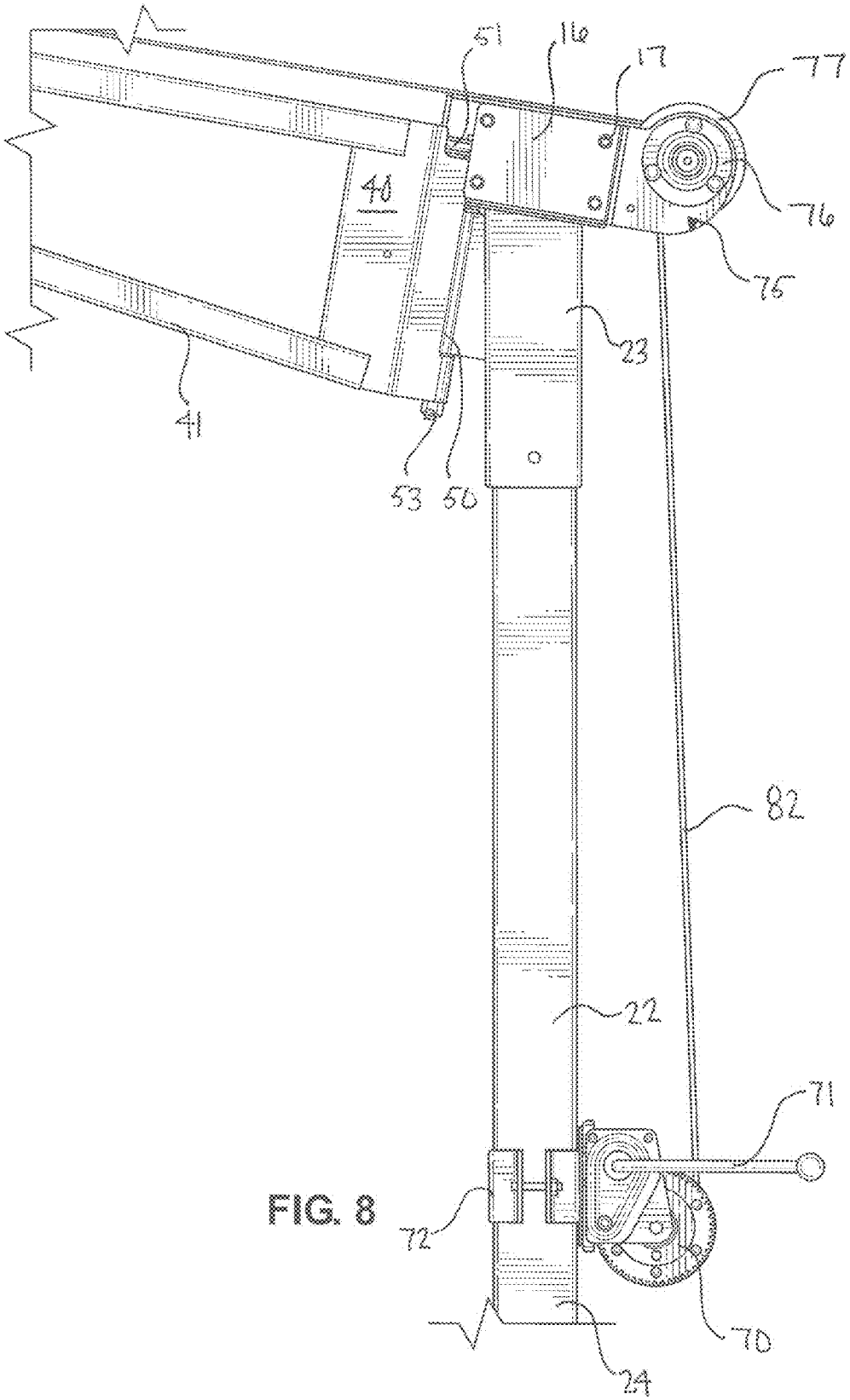
FIG. 8 depicts a side view of a preferred embodiment of a substantially vertical support leg of a portable shade assembly of the present invention, generally comprising a second winch member and a cable.

FIG. 8 depicts a side view of support leg 22 generally comprising a second winch member 70. Support leg 22 comprises top end 23 and bottom end 24, wherein top end 23 is attachably connected to rear beam 30, and bottom end 24 is attachably connected to base 21. Further, front end 33 of rear beam 30 is attachably connected to arm members 40 via first hinge 50, and back end 34 of rear beam 30 is attachably connected to fabric reel 12 via plate 16 and bolts 17, or any other similar attachment means. Second winch 70, or fabric reel winch, is attachably connected to bottom end 24 of support leg 22 via a clamp 72, or any other similar attachment means, wherein second winch 70 further comprises a handle 71, or a crank, in order to wind up or unwind a cable 82. Cable 82 is beneficially coiled through second winch 70 and then runs in a substantially upward direction to spool 75, thereby controlling a winding and unwinding movement of fabric reel 12, and thus, shade screen 10. Although, in a preferred embodiment, fabric reel winch 70 can be manually utilized via handle 71 in order to wind or unwind cable 82, it is to be observed that fabric reel winch 70 can also be manufactured with a variety of other designs or mechanisms, including, but not limited to, a motorized fabric reel winch.

Thus, in a preferred embodiment, second winch 70 allows for screen shade 10 to be extended in a substantially outward manner or retracted in a substantially inward manner, while simultaneously allowing frame member 20 to extend while supporting screen shade 10. As a result, fabric reel winch 70 controls movement of fabric reel 12, wherein fabric reel 12 is attachably connected to an end of fabric screen 10, and fabric screen 10 controls the amount of force that is being transferred to arm members 40 of frame 20.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for use in portably providing shade and sun protection, comprising:

a) a frame member, having a base, a plurality of substantially vertical support legs, a plurality of substantially horizontal support beams, and a plurality of extendable arm members;

b) a winch assembly comprising a plurality of coiled springs that are attachably connected to a cable member, wherein said cable member runs through said substantially horizontal support beams and said extendable arm members of said frame member; and c) a substantially horizontal screen member disposed between said substantially horizontal support beams.

2. The apparatus of claim 1, wherein said substantially horizontal support beams comprise a rear beam and a front beam.

3. The apparatus of claim 2, further comprising a screen reel attachably connected to said rear beam, wherein one end of said substantially horizontal screen member is attachably connected to said screen reel, and an opposite end of said substantially horizontal screen member is attachably connected to said front beam.

4. The apparatus of claim 3, wherein said extendable arm members are disposed in a substantially perpendicular orientation to said rear beam and said front beam.

5. The apparatus of claim 4, wherein said winch assembly is disposed within said rear beam.

6. The apparatus of claim 5, wherein said winch assembly creates a tensional force across said coiled springs and said cable member.

7. The apparatus of claim 6, wherein said tensional force of said cable member is transferred to said extendable arm members.

8. The apparatus of claim 7, further comprising a screen reel winch and a screen reel cable, wherein said screen reel winch attachably connects said screen reel cable from said screen reel winch to said screen reel.

9. The apparatus of claim 8, further comprising a substantially vertical screen member, wherein said substantially vertical screen member is disposed along a substantially horizontal cable positioned between said rear beam and said screen reel.

10. A method for portably providing shade and sun protection comprising:

a) positioning a portable shade assembly in a desired location, wherein said portable shade assembly comprises:

i) a frame member, having a base, a plurality of substantially vertical support legs, a plurality of substantially horizontal support beams, and a plurality of extendable arm members;

ii) a winch assembly comprising a plurality of coiled springs that are attachably connected to a cable member, wherein said cable member runs through said substantially horizontal support beams and said extendable arm members of said frame member;

iii) a substantially horizontal screen member disposed between said substantially horizontal support beams;

b) extending said extendable arm members of said frame member and said substantially horizontal screen member into an open configuration when said portable shade assembly is in operation; and c) retracting said extendable arm members of said frame member and said substantially horizontal screen member into a closed configuration to prepare for transport when said portable shade assembly is no longer in operation.

11. The apparatus of claim 10, wherein said substantially horizontal support beams comprise a rear beam and a front beam.

12. The apparatus of claim 11, further comprising a screen reel attachably connected to said rear beam, wherein one end of said substantially horizontal screen member is attachably connected to said screen reel, and an opposite end of said substantially horizontal screen member is attachably connected to said front beam.

13. The apparatus of claim 12, wherein said extendable arm members are disposed in a substantially perpendicular orientation to said rear beam and said front beam.

14. The apparatus of claim 13, wherein said winch assembly is disposed within said rear beam.

15. The apparatus of claim 14, wherein said winch assembly creates a tensional force across said coiled springs and said cable member.

16. The apparatus of claim 15, wherein said tensional force of said cable member is transferred to said extendable arm members.

17. The apparatus of claim 16, further comprising a screen reel winch and a screen reel cable, wherein said screen reel winch attachably connects said screen reel cable from said screen reel winch to said screen reel.

18. The apparatus of claim 17, further comprising a substantially vertical screen member, wherein said substantially vertical screen member is disposed along a substantially horizontal cable positioned between said rear beam and said screen reel.

* * * * *